US009809913B2

(12) United States Patent
Okuda et al.

(10) Patent No.: US 9,809,913 B2
(45) Date of Patent: Nov. 7, 2017

(54) BULK RECOVERY APPARATUS FOR NONWOVEN FABRIC AND BULK RECOVERY METHOD FOR THE SAME

(71) Applicant: UNICHARM Corporation, Ehime (JP)

(72) Inventors: Jun Okuda, Kagawa (JP); Satoshi Mitsuno, Kagawa (JP)

(73) Assignee: UNICHARM CORPORATION, Ehime (JP)

( * ) Notice: Subject to any disclaimer, the term of this patent is extended or adjusted under 35 U.S.C. 154(b) by 24 days.

(21) Appl. No.: 15/030,043

(22) PCT Filed: Oct. 6, 2014

(86) PCT No.: PCT/JP2014/076719
§ 371 (c)(1),
(2) Date: Apr. 15, 2016

(87) PCT Pub. No.: WO2015/056597
PCT Pub. Date: Apr. 23, 2015

(65) Prior Publication Data

US 2016/0251779 A1 Sep. 1, 2016

(30) Foreign Application Priority Data

Oct. 18, 2013 (JP) ..... 2013-217194

(51) Int. Cl.
*D06C 7/00* (2006.01)
*D04H 1/70* (2012.01)
*D06C 3/00* (2006.01)

(52) U.S. Cl.
CPC ..... *D06C 7/00* (2013.01); *D04H 1/70* (2013.01); *D06C 3/00* (2013.01)

(58) Field of Classification Search
CPC ... D06C 3/00; D06C 3/06; D06C 7/00; D06C 7/02; D06C 2700/09; F26B 3/04;
(Continued)

(56) References Cited

U.S. PATENT DOCUMENTS 1,670,991 A * 5/1928 Schilde ..... D06C 7/00 34/223
2,700,226 A * 1/1955 Dungler ..... D06C 7/00 34/656
(Continued)

FOREIGN PATENT DOCUMENTS

CN 1497086 A 5/2004
CN 102227528 A 10/2011
(Continued)

OTHER PUBLICATIONS

Written Opinion of the ISA in PCT Application No. PCT/JP2014/076719, mailed Dec. 22, 2014.
(Continued)

*Primary Examiner* — Amy Vanatta
(74) *Attorney, Agent, or Firm* — Hauptman Ham, LLP

(57) ABSTRACT

An apparatus for recovering bulkiness of a nonwoven fabric by blowing hot air and heating the nonwoven fabric transferred in a transfer direction, includes a case member that has both end portions in the transfer direction opened; an entrance and an exit provided to openings on opposite end sides, in the transfer direction, of the case member to transfer the nonwoven fabric; and a blast opening provided on the entrance side of the case member for blasting hot air inside the case member toward the exit. Inside the case member, a sectional area at a first position downstream of the blast opening is wider than at a second position located between the blast opening and the first position. Hot air blasted from the blast opening flows downstream through the first and second positions while coming into contact with one of two faces of the nonwoven fabric inside the case member.

8 Claims, 5 Drawing Sheets

(58) Field of Classification Search
CPC ..... F26B 13/06; F26B 13/08; F26B 13/005; F26B 13/108; F26B 13/12; F26B 13/103; F26B 13/104; F26B 21/022; F26B 25/10; F26B 25/08; F26B 25/12; F26B 25/14; F26B 25/16; F26B 13/10; D06B 1/02; D06B 1/08; D02J 1/02; D04H 1/70
USPC ..... 28/167, 271, 273, 275, 281; 26/106, 92; 68/5 D, 5 E; 34/580, 590, 620, 636, 579, 34/583, 589, 629, 633
See application file for complete search history.

(56) References Cited

U.S. PATENT DOCUMENTS 3,577,652 A * 5/1971 Evans ..... F26B 13/10 34/636
4,417,375 A * 11/1983 Sano ..... D02J 1/08 28/272
4,949,441 A * 8/1990 Ethridge ..... D02G 1/122 28/271
4,952,145 A * 8/1990 Kwiatkowski ..... B29C 35/06 126/92 AC
5,303,484 A * 4/1994 Hagen ..... F26B 13/104 34/460
5,333,395 A * 8/1994 Bulcsu ..... F26B 13/005 34/644
5,511,295 A * 4/1996 Shah ..... D02G 1/161 28/254
6,088,892 A * 7/2000 Bertsch ..... D02G 1/161 28/254
6,397,444 B1 * 6/2002 Foster ..... D02G 1/02 28/220
7,268,323 B2 * 9/2007 Tomobe ..... B29C 71/02 219/388
2004/0111848 A1 * 6/2004 Miyamoto ..... A61F 13/15699 28/165
2011/0191994 A1 * 8/2011 Takahashi ..... D04H 1/498 28/167
2015/0067996 A1 * 3/2015 Okuda ..... D04H 1/50 26/106
2015/0211157 A1 * 7/2015 Okuda ..... D04H 3/04 442/334

FOREIGN PATENT DOCUMENTS

DE 3603435 C2 11/1993
JP 2004-137655 A 5/2004
JP 2009-155756 A 7/2009
JP 2012-97087 A 5/2012
JP 5102610 B2 12/2012
WO 2010/047292 A1 4/2010
WO 2013/157611 A1 10/2013

OTHER PUBLICATIONS

International Search Report in PCT/JP2014/076719, mailed Dec. 22, 2014.

* cited by examiner

BULK RECOVERY APPARATUS FOR NONWOVEN FABRIC AND BULK RECOVERY METHOD FOR THE SAME

RELATED APPLICATIONS

The present application is a National Phase entry of International Application No. PCT/JP2014/076719, filed Oct. 6, 2014, which claims priority of Japanese Application No. 2013-217194, filed Oct. 18, 2013.

TECHNICAL FIELD

The present invention relates to a bulk recovery apparatus for nonwoven fabric and a bulk recovery method for nonwoven fabric.

BACKGROUND ART

Sanitary napkins and disposable diapers have been conventionally used as absorbent articles. And pee pads for pets included within the category of the above absorbent articles are also widely used as toilets for pets. A liquid permeable top sheet is provided to the part of such absorbent articles which contacts such as the user's skin. And recently, bulky nonwoven fabric is preferred as the material of the top sheet since a high capturing performance is required from the viewpoint of reducing the sticky touch felt by the skin.

Such nonwoven fabric is manufactured in a strip form by appropriate methods such as the carding method, and are wound in a rolled form thereafter to be stored in states of nonwoven fabric rolls. And the nonwoven fabric roll is brought to the absorbent article manufacturing line when the nonwoven fabric is to be used, then the nonwoven fabric is unrolled from the above nonwoven fabric roll at the above manufacturing line to be used as the material for the top sheet.

Meanwhile, tensile force in the winding direction is applied in order to avoid the nonwoven fabric from meandering and the like when winding the nonwoven fabric into a roll of nonwoven fabric. For such reason, the nonwoven fabric is usually wound tightly by this tensile force. In other words, this nonwoven fabric is compressed in the thickness direction to be in a state such that the bulkiness is reduced. Therefore, only nonwoven fabric with its bulk reduced would be unrolled and provided when the nonwoven fabric is unrolled from the nonwoven fabric roll at the absorbent article manufacturing line, that is, the aforementioned requirement of a bulky nonwoven fabric would not be met.

There is known, as a method of increasing the bulk of nonwoven fabric, a process such as blowing hot air against the surface of the nonwoven fabric to heat the surface of the nonwoven fabric so that the fibers of the compressed nonwoven fabric would return to its initial state. PTL 1 discloses, for example, a method of preparing a heating chamber for heating nonwoven fabric and blowing hot air into either the entrance side or the exit side when the nonwoven fabric is transferred from the entrance side to the exit side of the heating chamber. The hot air blown into the heating chamber is discharged from the other side of the entrance or the exit so to flow along the surface of the nonwoven fabric in the heating room allowing the nonwoven fabric to recover its bulk.

CITATION LIST

Patent Literature

[PTL 1] Japanese Laid-open Application No. 2012-097087

SUMMARY OF INVENTION

Technical Problem

The bulk recovery apparatus heats the nonwoven fabric to soften the nonwoven fabric. Therefore, the nonwoven fabric can easily stretch in the transfer direction when tensile strength in the transfer direction acts thereagainst. And in a case when the hot air flows along the surface of the nonwoven fabric as in PTL 1, the nonwoven fabric can further easily stretch in the transfer direction by being pulled by the hot air flow when the speed (flow rate) of the hot air flow is fast. Particularly, the nonwoven fabric would be subject to the hot air and heated for a long time at the downstream side along the transfer direction in the heating chamber so that the effects by the stretching of the nonwoven fabric would increase when the flow rate of the hot air is too fast in the above area and thus it would be difficult to perform a normal bulk recovery.

The present invention has been made in view of the above circumstances and an objective thereof is to appropriately adjust the flow rate of the hot air in a device that performs bulk recovery by blowing the hot air against the nonwoven fabric being transferred.

Solution to Problem

A main aspect of the invention for achieving the above objective is an apparatus that recovers a bulk of a nonwoven fabric by blowing hot air and heating the nonwoven fabric that is transferred in a transfer direction, including: a case member that has both end portions thereof in the transfer direction opened; an entrance that is provided to an opening on one end side, in the transfer direction, of the case member, the entrance being used to transfer the nonwoven fabric; an exit that is provided to an opening on an other end side, in the transfer direction, of the case member, the exit being used to transfer the nonwoven fabric; and a blast opening that is provided to a part on the entrance side of the case member and blasts into a space inside the case member the hot air toward a part on the exit side, wherein a sectional area at a first position, of the space inside the case member, on a downstream side along the transfer direction with respect to a position where the blast opening is provided, is wider than a sectional area at a second position, of the space inside the case member, located between the position where the blast opening is provided and the first position and the hot air that is blasted from the blast opening flows from an upstream side along the transfer direction through the first and second positions and to the downstream side along the transfer direction while coming into contact with one face of two faces of the nonwoven fabric in the space inside the case member.

Other features of the present invention will be made clear through the present specification with reference to the accompanying drawings.

Advantageous Effects of Invention

According to the present invention, the flow rate of the hot air can be appropriately adjusted in a device that performs bulk recovery by blowing the hot air against the nonwoven fabric being transferred.

DESCRIPTION OF EMBODIMENTS

Figure 1A:
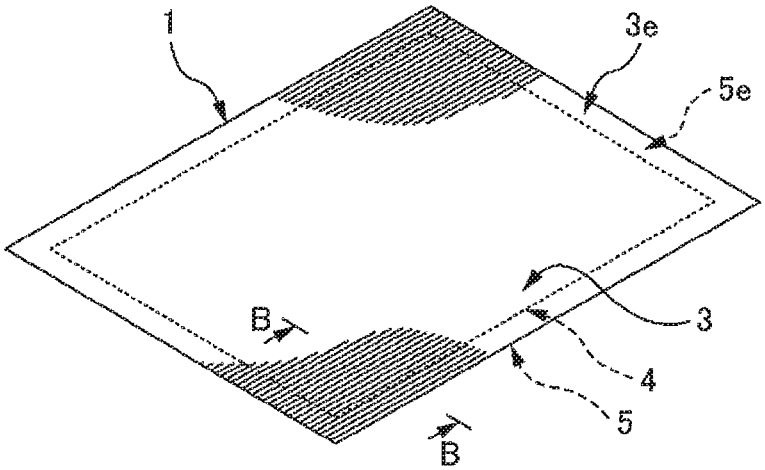
FIG. 1A is an external perspective view illustrating a pee pad 1 as an example of an absorbent article.

At least the following matters will become clear through the description of the present specification and the accompanying drawings.

An apparatus that recovers a bulk of a nonwoven fabric by blowing hot air and heating the nonwoven fabric that is transferred in a transfer direction, including: a case member that has both end portions thereof in the transfer direction opened; an entrance that is provided to an opening on one end side, in the transfer direction, of the case member, the entrance being used to transfer the nonwoven fabric; an exit that is provided to an opening on an other end side, in the transfer direction, of the case member, the exit being used to transfer the nonwoven fabric; and a blast opening that is provided to a part on the entrance side of the case member and blasts into a space inside the case member the hot air toward a part on the exit side, wherein a sectional area at a first position, of the space inside the case member, on a downstream side along the transfer direction with respect to a position where the blast opening is provided, is wider than a sectional area at a second position, of the space inside the case member, located between the position where the blast opening is provided and the first position and the hot air that is blasted from the blast opening flows from an upstream side along the transfer direction through the first and second positions and to the downstream side along the transfer direction while coming into contact with one face of two faces of the nonwoven fabric in the space inside the case member.

According to such a bulk recovery apparatus for nonwoven fabrics, the flow rate of the hot air can be reduced by expanding the hot air flow path area (sectional area) in a downstream side area along the transport direction. Hereby, the flow rate of the hot air is appropriately adjusted so to restrain the nonwoven fabric from stretching in the transfer direction which in turn allows a normal bulk recovery to be performed.

It is preferable that in the nonwoven fabric bulk recovery apparatus, an area that includes the first position and has a sectional area wider than that at the second position, in the space inside the case member has provided a discharge opening that discharges to an outside the hot air blasted in the space inside the case member.

According to such a bulk recovery apparatus for nonwoven fabrics, the volume of the hot air can be reduced in the downstream side area along the transport direction by discharging from the discharge opening a part of the hot air blasted into the case member. Hereby, the flow rate of the hot air at the downstream side area along the transport direction can be reduced.

It is preferable that in the nonwoven fabric bulk recovery apparatus, the discharge opening is provided to a location vertically shifted from a path along which the nonwoven fabric is transferred.

According to such a bulk recovery apparatus for nonwoven fabrics, issues relating to the transfer operation of the nonwoven fabric being interfered and the like by the effects due to the flow caused by the hot air being discharged from the discharge opening is unlikely to occur so that a correct transfer operation of the nonwoven fabric can be performed.

It is preferable that in the nonwoven fabric bulk recovery apparatus, the blast opening and the discharge opening are both provided at locations vertically shifted to a same side with respect to the path along which the nonwoven fabric is transferred.

According to such a bulk recovery apparatus for nonwoven fabrics, the hot air blasted from the blast opening which is provided to the upstream side in the transfer direction would flow along the transfer direction without penetrating the nonwoven fabric and be discharged outside from the discharge opening provided to the downstream side along the transfer direction. Hereby, one face of the nonwoven fabric (e.g., lower face side of the nonwoven fabric) can be heated sufficiently which in turn allows an effective bulk recovery.

It is preferable that in the nonwoven fabric bulk recovery apparatus, a member that blocks a part of a space on an exit side of the space inside the case member is provided at a part most downstream along the transfer direction in the space inside the case member.

According to such a bulk recovery apparatus for nonwoven fabrics, the flow of the hot air is narrowed by reducing the sectional area of the exit portion of the case member allowing regulation of the hot air flow. Hereby, the transfer operation of the nonwoven fabric at the above exit portion is unlikely to be disturbed so that a stable bulk recovery operation can be performed.

It is preferable that the nonwoven fabric bulk recovery apparatus further includes a hot air supply device that supplies the hot air to an inside of the case member, wherein the hot air supply device recovers the hot air discharged from the discharge opening to resupply to an inside of the case member.

According to such a bulk recovery apparatus for nonwoven fabrics, some energy can be reused while suppressing an adverse effect on the other proximate semimanufactured products when the hot air is discharged from the case member.

It is preferable that the nonwoven fabric bulk recovery apparatus further includes a CD direction that is a direction orthogonal to each of a vertical direction of the case member and the transfer direction, wherein the discharge of the hot air from the discharge opening and the supply of the hot air to the inside of the case member are performed on a same side with respect to the CD direction of the case member.

According to such a bulk recovery apparatus for nonwoven fabrics, the tube for supplying hot air and the tube for discharging and recovering hot air can be connected on the same side with respect to the CD direction and thus the space for the piping can be reduced. Hereby, the overall size of the bulk recovery apparatus can be minimized.

Further, there will be made clear a method of recovering a bulk of a nonwoven fabric by blowing hot air and heating the nonwoven fabric that is transferred in a transfer direction, including: when an entrance is provided to an opening on one end side in the transfer direction to transfer the nonwoven fabric and an exit is provided to an opening on an other end side in the transfer direction to transfer the nonwoven fabric, in a case member that has both end portions thereof in the transfer direction opened, blasting from a blast opening provided to a part on the entrance side of the case member the hot air toward a part on the exit side and into a space inside the case member; and in the case member having a sectional area, in the space inside the case member, at a first position that is located on a downstream side along the transfer direction with respect to a position where the blast opening is provided, wider than a sectional area, in the space inside the case member, at a second position that is located between the position where the blast opening is located and the first position, allowing the hot air blasted from the blast opening to flow from an upstream side along the transfer direction through the first and the second positions and to the downstream side along the transfer direction while coming into contact with one face of two faces of the nonwoven fabric.

According to such a bulk recovery method for nonwoven fabrics, the flow rate of the hot air can be lowered by expanding the hot air flow path area (sectional area) in a downstream side area along the transport direction. Hereby, the flow rate of the hot air is appropriately adjusted so to restrain the nonwoven fabric from stretching in the transfer direction which in turn allows a normal bulk recovery to be performed.

Embodiment

<Nonwoven Fabric as Target of Bulk Recovery>

The bulk recovery apparatus 20 and the bulk recovery method for nonwoven fabric 3 according to the present embodiment aims to processes the nonwoven fabric 3 which becomes the top sheet 3 of the pee pad 1 for pets.

Figure 1B:
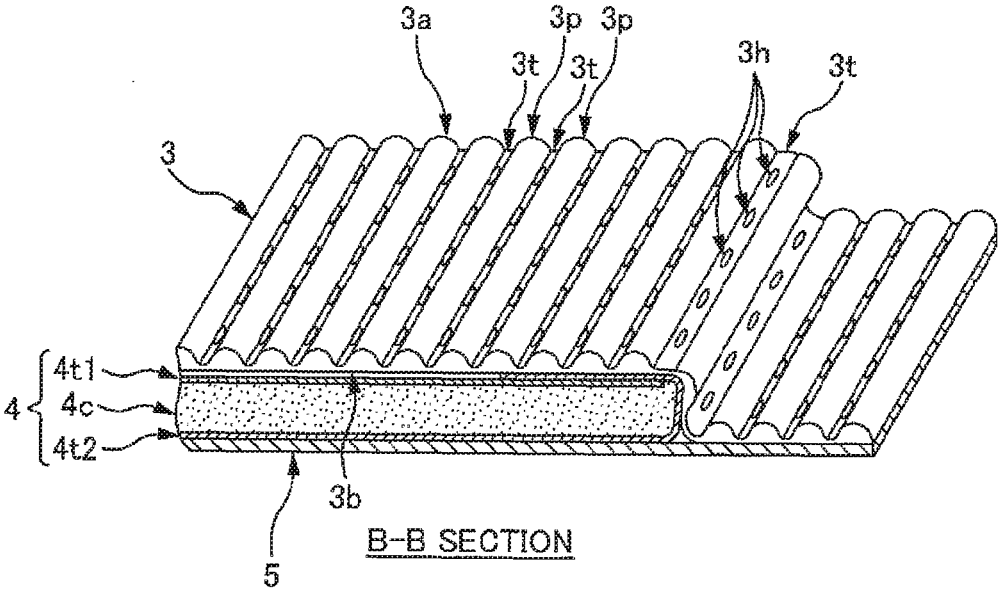
FIG. 1B is an enlarged perspective view when the pee pad 1 is cut along line B-B of FIG. 1A.

FIG. 1A is an external perspective view illustrating a pee pad 1 as an example of an absorbent article and FIG. 1B is an enlarged perspective view when the pee pad 1 is cut along line B-B of FIG. 1A.

The pee pad 1 is used to catch excrement of animals such as dogs and cats and is used by placing the pee pad 1 on the floor and the like, as illustrated in FIG. 1A. This pee pad 1 includes, for example, a liquid permeable top sheet 3 in a rectangular shape when seen in a planar view, a liquid impermeable back sheet 5 in approximately the same shape as the top sheet 3, and a liquid absorptive absorbent body 4 which is inserted between these sheets 3 and 5. And the absorbent body 4 is adhered to both the top sheet 3 and the back sheet 5 using hot melt adhesives and the like. Further, the top sheet 3 and the back sheet 5 are adhered with hot melt adhesives and the like at the parts 3*e* and 5*e* which extend out sideward from the absorbent body 4, that is, the outer circumferential edges 3*e* and 5*e* of the sheets 3 and 5.

As illustrated in FIG. 1B, the absorbent body 4 includes an absorbent core 4*c* which is formed by layering, for example, liquid absorbent fiber such as pulp fiber and super absorbent polymer (so-called SAP) in a substantially rectangular form when seen in a planar view. This core 4*c* may be covered with two liquid permeable covering sheets 4*t*1, 4*t*2 such as tissue paper as in this example. In other words, the core 4*c* is covered with one covering sheet 4*t*1 on the skin side face and with another covering sheet 4*t*2 on the non-skin side face. Note that, a single covering sheet may cover the entire absorbent core 4*c* in some cases.

The back sheet 5 is, for example, a film material such as polyethylene (hereinafter, PE), polypropylene (hereinafter, PP), polyethylene terephthalate (hereinafter, PET) and the like. However, it is not limited to such and any liquid permeable sheet may be used.

The top sheet 3 is made of a nonwoven fabric 3 material. In this example, one face 3*b* of the two faces 3*a*, 3*b* of the nonwoven fabric is in an approximately flat plane, but the other face 3*a* is in a corrugated shape. In other words, linear grooves 3*t* and linear bumps 3*p* are formed alternately. These bumps 3*p*, 3*p* . . . are formed by having the fibers originally existing at the grooves 3*t* blown sideways to be raised by a well known air blowing process (see such as Japanese Patent Application Laid-open Publication No. 2009-11179), with the fibers in loose states. And hereby, this nonwoven fabric 3 as a whole is made bulky. Further, a plurality of through holes 3*h*, 3*h* . . . penetrating in the thickness direction may be formed to the grooves 3*t*, as in this example.

The average basis weight of this nonwoven fabric 3 is, for example, 10 to 200 (g/m$^2$), the average basis weight at the center parts of the bumps 3*p* is, for example, 15 to 250 (g/m$^2$) and the average basis weight at the bottom portions of the grooves 3*t* is 3 to 150 (g/m$^2$).

Further, it is preferable that the fiber of the nonwoven fabric 3 is a composite fiber type having a so-called core-sheath structure which is configured of a core and a sheath made of different materials, however, fiber having a side-by-side structure may be used or a single fiber type made of only thermoplastic resin may be used.

Furthermore, the nonwoven fabric 3 may include crimped fiber. Here, crimped fiber is fiber in a crimped form such as a wavy form, a pinched form, a helical form and the like.

And the fiber length of the fibers included in the nonwoven fabric 3 is selected from the range of, for example, 20 to 100 mm and the fineness is selected from the range of, for example, 1.1 to 8.8 (dtex).

<Description of the Bulk Recovery Apparatus>

The pee pad 1 is manufactured in a pee pad 1 manufacturing line and the nonwoven fabric 3 used as the top sheet 3 is brought into this manufacturing line in a nonwoven fabric roll 3R (FIG. 2) form. In other words, the nonwoven fabric 3 having the aforementioned bumps 3*p* is stored once rolled in a roll form and then the nonwoven fabric roll 3R is brought from the storage to the pee pad 1 manufacturing line. Thereafter, the nonwoven fabric 3 is mounted to the supply device 35 equipped to this manufacturing line to be supplied as the material for the top sheet 3.

However, as aforementioned, there is a possibility that the bulk of the nonwoven fabric 3 would be flattened when in the nonwoven fabric roll 3R. For such reason, this manufacturing line is provided with a bulk recovery apparatus 20.

Figure 2:
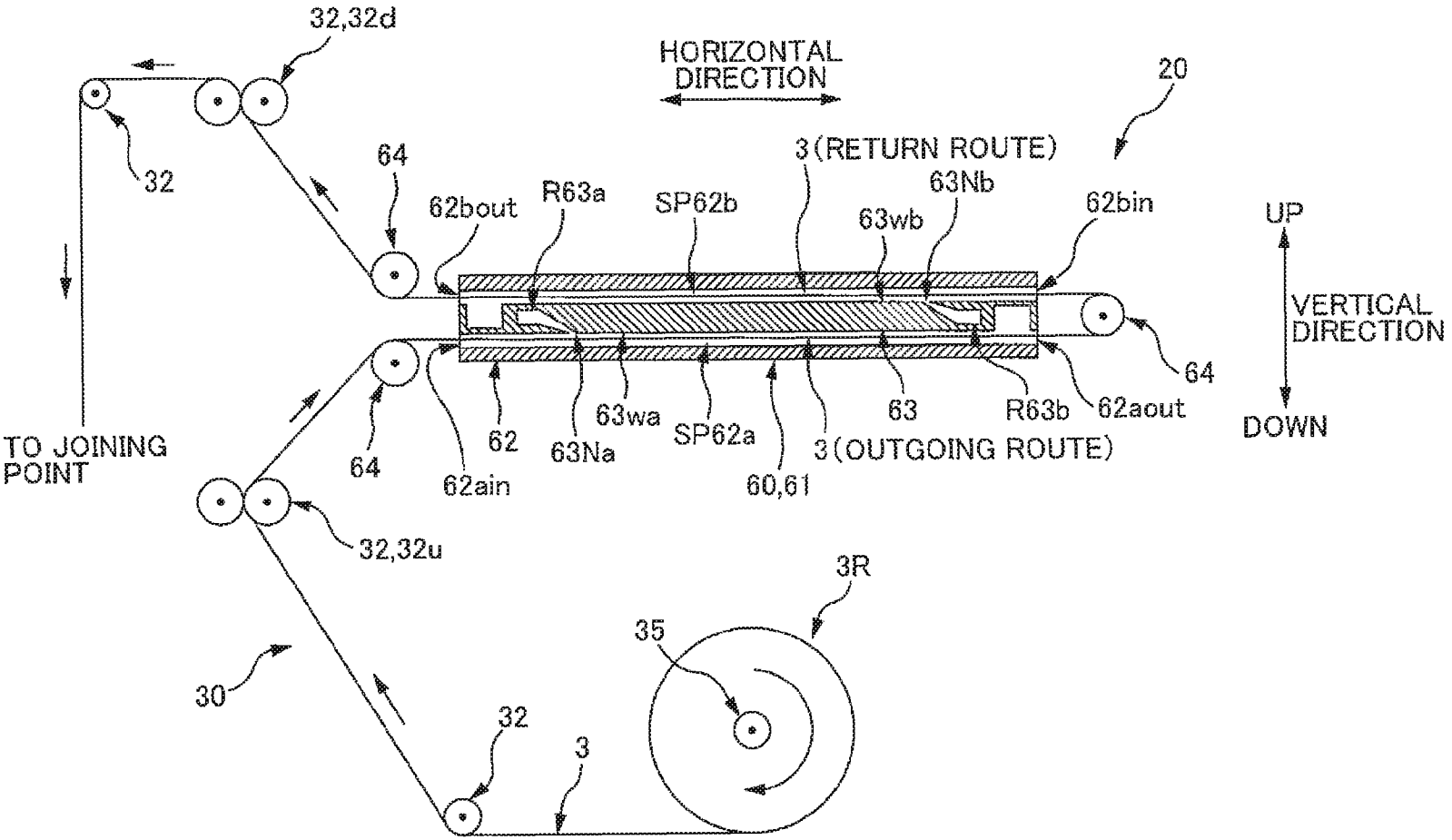
FIG. 2 is a schematic side view illustrating the bulk recovery apparatus 20 according to the present embodiment.
Figures 3A, 3B:
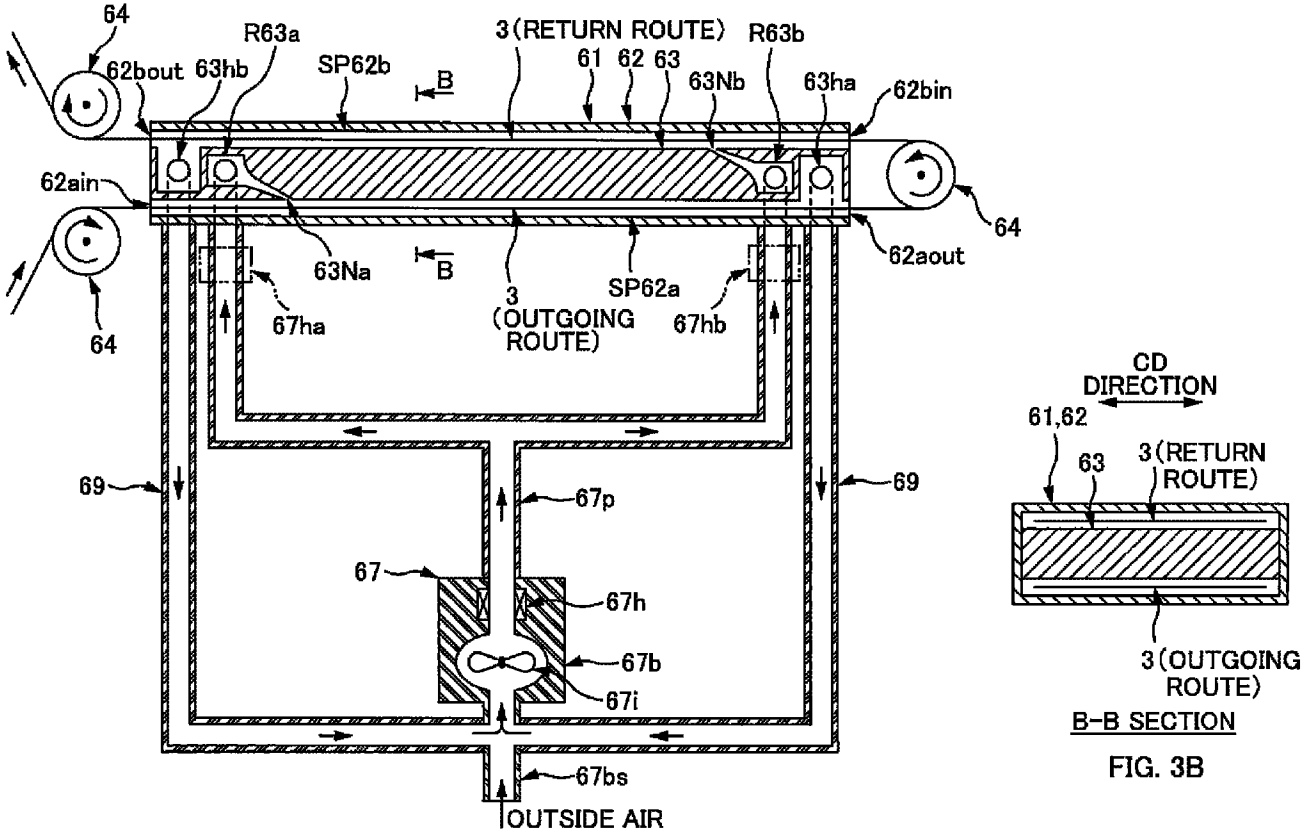
FIG. 3A is an explanatory view of a heating portion 60 configuring the main portion of the bulk recovery apparatus 20.
FIG. 3B is a sectional view taken along line B-B of FIG. 3A.
Figure 4:
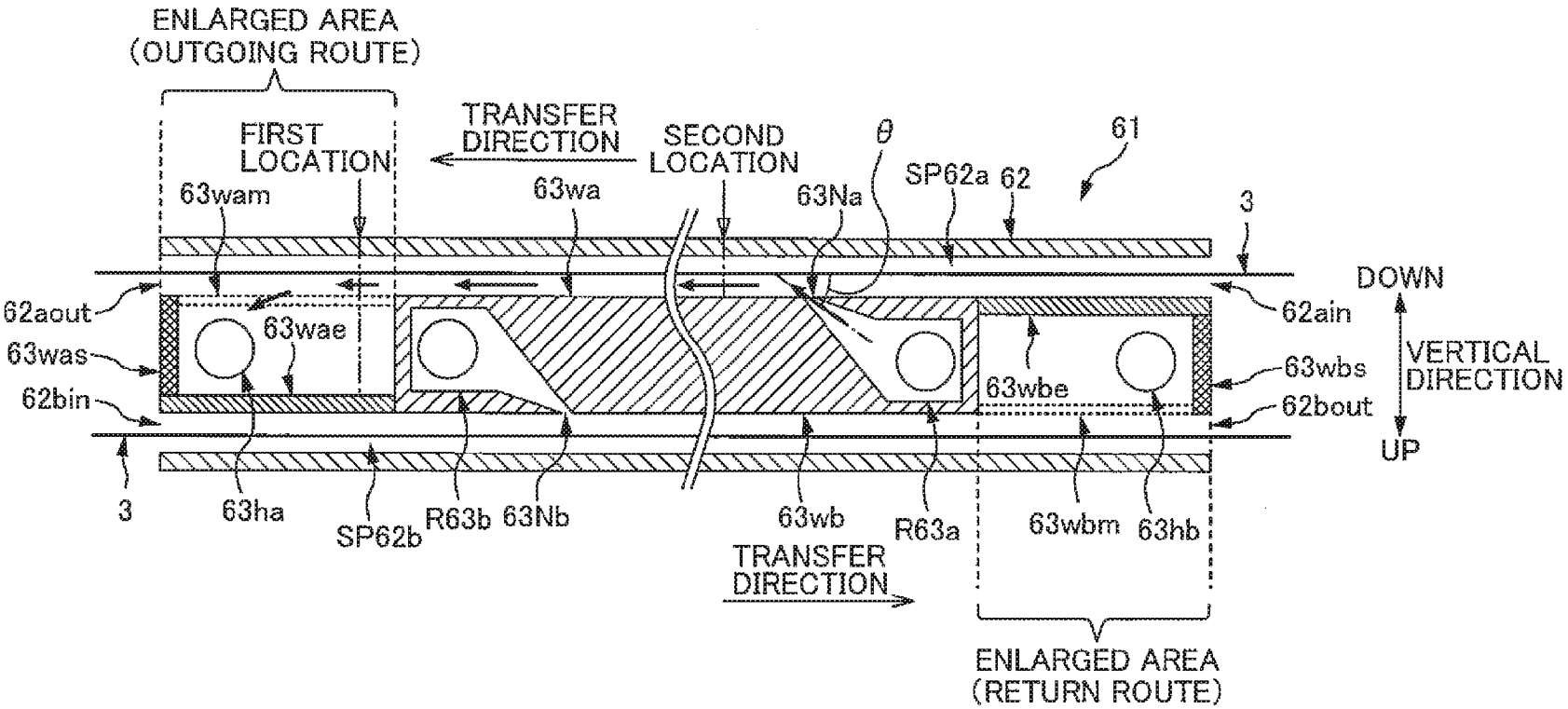
FIG. 4 is a view illustrating the details of the interior in the case member 62 of the heating unit 61.

FIG. 2 is a schematic side view of the bulk recovery apparatus 20. FIG. 3A is an explanatory view of a heating portion 60 configuring the main portion of the bulk recovery apparatus 20 and FIG. 3B is a sectional view taken along line B-B of FIG. 3A. Here, FIGS. 2 and 3A show sectional views of the heating unit 61 configuring the main portion of the heating portion 60. FIG. 4 is a view illustrating the details of the interior in the case member 62 of the heating unit 61.

Note that in FIG. 4, the vertical direction is illustrated reversely with respect to that in FIG. 2.

As illustrated in FIG. 2, the bulk recovery apparatus 20 includes a transfer portion 30 which rolls out the nonwoven fabric 3 from the nonwoven fabric roll 3R to be transferred along a predetermined transfer path, a heating portion 60 which heats the nonwoven fabric 3 at a predetermined location on the transfer path, and a controller (not shown) which controls the transfer portion 30 and the heating portion 60. And the nonwoven fabric 3 which was heated with the heating portion 60 to have the bulk recovered is sent to the point where nonwoven fabric joins the other semi-manufactured goods relating to the pee pad 2, such as the absorbent body 4, located on the downstream side along the transfer direction, and is joined with the above semimanufactured good at this joining point.

By the way, similar to the bulk recovery apparatus 20, the various devices (not shown) on the manufacturing line are arranged on this line supported by an appropriate support member. And in this example, a so-called faceplate (not shown) is used as an example of this support member. The faceplate is a plate member provided to stand vertically on the floor portion of the manufacturing line and this faceplate includes a vertical plane (a plane whose normal direction faces the horizontal direction) and the various devices are supported by this vertical plane in for example, a cantilevered state.

And in the following description, the direction normal to this vertical plane will be called the "CD direction". Here in FIG. 2, the CD direction is directed in the direction which penetrates the plane of the paper of FIG. 2 and to be specific, the CD direction is directed in the direction that penetrates the plane of the paper of FIG. 2, among any direction which is in the horizontal plane. And since the nonwoven fabric 3 which has been rolled out is basically transferred in a position having the width direction of the nonwoven fabric 3 facing the CD direction, the transfer direction of the nonwoven fabric 3 would be directed in any direction which is orthogonal to the CD direction. It should be noted that the support member is not limited to the faceplate and other support members may be used.

(Transfer Portion 30)

The transfer portion 30 includes a plurality of transfer rollers 32, 32 . . . which define the transfer path of the nonwoven fabric 3 and a supply device 35.

The transfer rollers 32, 32 . . . are rotatably supported about the rotating shaft which comes along the CD direction and hereby the nonwoven fabric 3 is transferred in a position having the width thereof facing the CD direction. Some of the transfer rollers 32, 32 among the transfer rollers 32, 32 . . . are drive rollers 32*u*, 32*d* which are driven to rotate with the servo motor which acts as the drive source. And the other rollers 32, 32 . . . are follower rollers which do not have a drive source in other words, are rollers that are rotated by the rotating force caused by coming into contact with the nonwoven fabric 3 being transferred.

The drive rollers 32*u*, 32*d* are provided to the positions on the two sides of the heating portion 60 (specifically, the later described heating unit 61) at the transfer path. And the transfer state of the nonwoven fabric 3 at the heating portion 60 can be adjusted by controlling the rotational movement of the upstream side drive transfer rollers 32*u* and the downstream side drive transfer rollers 32*d*.

The supply device 35 is a device which supplies the nonwoven fabric 3 from the nonwoven fabric roll 3R and includes a rotating shaft which is arranged along the CD direction. And the nonwoven fabric roll 3R is rotatably supported by this rotating shaft. The rotating shaft is driven to rotate by, for example, a servo motor (not shown) which serves as the drive source and hereby, the nonwoven fabric 3 is supplied from the nonwoven fabric roll 3R. Here, a plurality e.g. two) of the supply devices 35 may be provided to have a plurality (two) of the nonwoven fabric rolls 3R alternatively used by switching. That is, the configuration may be such that while one of the supply devices 35 is supplying the nonwoven fabric 3, the other supply device 35 is in a waiting state and when the nonwoven fabric roll 3R of the one of the supply devices 35 is used up the supply device 35 in a waiting state may start supplying the nonwoven fabric 3. Note that, the detailed description of this supply device 35 is omitted since the supply device 35 is well known.

Further, an accumulator device and a tension control device (both not shown) may be equipped, to the transfer portion 30, between the supply device 35 and the upstream side drive transfer roller 32*u*. The accumulator device is a device which deliverably accumulates toward the downstream along the transfer direction the nonwoven fabric 3 supplied by the supply device 35. For example, when one supply device 35 among the two supply devices 35 supplies all the nonwoven fabric 3 from the nonwoven fabric roll 3R and the supply device 35 stops when switching to the other supply device 35, the accumulator device itself delivering the accumulated nonwoven fabric 3 can avoid effects to the downstream caused by stopping the supply by the supply device 35. The tension control device is a device which adjusts to a predetermined target value (N) the tensility (N) of the nonwoven fabric 3 to be transferred.

(Heating Portion 60)

The heating portion 60 includes a heating unit 61 which while allowing the nonwoven fabric 3 to pass therethrough blows hot air against the nonwoven fabric 3 for heating and a hot air supply device 67 which supplies hot air to this heating unit 61.

The heating unit 61 includes a case member 62 having both end sections along the longitudinal direction opened and a plurality of guide rollers 64, 64, 64 which are provided outside the case member 62 to allow the nonwoven fabric 3 to be guided and reciprocate inside the case member 62. And an outgoing route and a return route of the transfer path of the nonwoven fabric 3 are linearly formed inside the case member 62 by the guide rollers 64, 64, 64. Additionally, as illustrated in FIG. 3A, a partitioning member 63 which forms the wall surface along the transfer direction of the nonwoven fabric 3 is formed inside the case member. This partitioning member 63 (wall surface) sections the space inside the case member 62 into the outgoing route space SP62*a* and the return route space SP62*b*. In other words, the outgoing route space SP62*a* and the return route space SP62*b* are separated so that air cannot communicate between the two. Further, separation with this partitioning member 63 allows to have formed on one end portion of the two end portions in the lengthwise direction of the case member 62 both an outgoing route entrance 62*ain* and a return route exit 62*bout* for the nonwoven fabric 3. And the other end portion has formed both the outgoing route exit 62*aout* and the return route entrance 62*bin* for the nonwoven fabric 3.

Of the two wall surfaces 63*wa*, 63*wb* of the partitioning member 63 the wall surface 63*wa* (hereinafter, outgoing route wall surface 63*wa*) which is adjacent to the outgoing route space SP62*a*, and of the two wall surfaces 63*wa*, 63*wb* the wall surface 63*wb* (hereinafter, return route wall surface 63*wb*) which is adjacent to the return route space SP62*b* are respectively arranged parallel to the transfer direction and the CD direction. Hereby, the outgoing route wall surface 63*wa* and the return route wall surface 63*wb* are respectively made substantially parallel with the faces of the nonwoven fabric 3. And the upstream side part along the transfer direction of the outgoing route in the outgoing route wall surface 63*wa* has provided thereto a blast opening 63Na in a slit form long in the CD direction and the upstream side part along the transfer direction of the return route in the return route wall surface 63*wb* also has provided thereto a blast opening 63Nb in a slit form long in the CD direction. And the blast opening 63Na blasts into the return route space SP62*b* hot air supplied from the pressure chamber R63*a* formed inside the partitioning member 63. Similarly, the blast opening 63Nb blasts into the return route space SP62*b* hot air supplied from the pressure chamber R63*a* formed inside the partitioning member 63.

At the outgoing route wall surface 63*wa*, a level differentiated part 63*wae* is provided to the area along the transport direction downstream with respect to the location where the blast opening 63Na is provided, as illustrated in FIG. 4. And the outgoing route space SP62*a* has the sectional area of the flow path at the part on the downstream side along the transport direction expanded with this level differentiated part 63*wae*. In other words, the sectional area of the outgoing route space SP62*a* having the transport direction as the normal direction thereof, is wider at the downstream side area along the transport direction than that at the position where the blast opening 63Na is located. To put it in another way, the sectional area of the space SP62*a* at a first position on the side downstream along the transfer direction with respect to the location where the blast opening 63Na is positioned is wider than the sectional area of the space SP62*a* at a second position which is located between the location where the blast opening 63Na is positioned and the first position, along the transport direction. The area where this sectional area is widened will be called the enlarged area, in the following.

Further, an exit portion wall face 63*was* is provided most downstream along the transfer direction of the level differentiated part 63*wae*. The 63*was* is a member which is provided in a manner blocking a part of the exit side space of the outgoing route space SP62*a* and the outgoing route exit 62*aout* is formed with this 63*was* while defining the dimension of the exit 62*aout*. Additionally, a discharge opening 63*ha* for discharging to the outside the hot air blasted into the outgoing route space SP62 is provided to the side portion (wall face at the end portion in the CD direction in the outgoing route enlarged area in the case member 62) of the space formed with the level differentiated part 63*wae* and the exit portion wall face 63*was* of the outgoing route space SP62*a*. Here, the area (outgoing route enlarged area) having the sectional area of the space SP62*a* widened with the level differentiated part 63*wae* may be provided with a plate-like member 63*wam* placed along the transfer direction (indicated by dotted lines in FIG. 4). The plate-like member 63*wam* is a planar member having numerous minute holes on the surface thereof and can allow gas to freely flow therethrough via the holes from the surface side to the back side of the plate-like member 63*wam*. When performing bulk recovery of the nonwoven fabric 3 using the bulk recovery apparatus 20, there may be case where a foreign matter such as fiber dust and the like being generated by heating the nonwoven fabric 3, however, the plate-like member 63*wam* holes would make it difficult for such foreign matters to pass through. In other words, the plate-like member 63*wam* functions as a filter and suppresses the foreign matters from being discharged through the discharge opening 63*ha* together with the hot air. For example, meshed material, perforated metal and the like can be used as the 63*wam*.

Similarly, at the return route wall surface 63*wb*, a level differentiated part 63*wbe* is provided to the area along the transport direction downstream with respect to the location where the blast opening 63Nb is provided and the return route space SP62*b* has the flow path area widened at a part on the downstream side along the transfer direction. In other words, the sectional area of the return route space SP62*b* having the transport direction as the normal direction thereof, is wider (return route enlarged area) at the downstream side area along the transport direction than that at the position where the blast opening 63Nb is located. Further, an exit portion wall face 63*wbs* is provided most downstream along the transfer direction of the level differentiated part 63*wbe*. The 63*wbs* is a plate-like member which is provided in a manner blocking a part of the exit side space of the outgoing route space SP62*b* and the return route exit 62*bout* is formed with this 63*wbs* while defining the dimension of the exit 62*bout*. Additionally, a discharge opening 63*hb* for discharging to the outside the hot air blasted into the return route space SP62 is provided to the side portion (wall face at the end portion in the CD direction in the return route enlarged area in the case member 62) of the space formed with the level differentiated part 63*wbe* and the exit portion wall face 63*wbs*, in the return route space SP62*b*. Here, the area (return route enlarged area) having the sectional area of the space SP62*b* widened with the level differentiated part 63*wbe* may be provided with a plate-like member 63*wbm* placed along the transfer direction. The 63*wbm* has a function similar to that of the aforementioned 63*wam*.

The hot air supply device 67 includes an air blower 67*b* and a heater 67*h*. And hot air is generated by heating with the heater 67*h* wind generated with the air blower 67*b*, and this hot air is supplied to the pressure chambers R63*a*, R63*b* of the partitioning member 63 inside the case member 62 of the aforementioned heating unit 61 through an appropriate tube member 67*p*. Thereafter, hot air is blasted out from the blast openings 63Na, 63Nb through the pressure chambers R63*a*, R63*b*. Here, the hot air is supplied to the pressure chambers R63*a*, R63*b* from the end portion side along the CD direction of the case member 62.

The air blower 67*b* includes, for example, an impeller 67*i* which is rotated by using a motor as the drive source and an inverter (not shown) which adjusts the rotational speed (rpm) of the aforementioned motor. And hereby, the VVVF inverter control with the controller (not shown) can be performed so that as a result the air volume ($m^3$/min) can be adjusted to any value through changing of the rotational speed (rpm) of the impeller 67*i*.

Here, as illustrated in FIG. 3A, the heater 67*h* may be built-in the air blower 67*b* or may be provided outside the air blower 67*b*. When the heater 67*h* is provided outside, it is preferable to arrange the heaters 67*ha*, 67*hb* proximate the case member 62 of the heating unit 61, as virtually illustrated using chain double-dashed lines in FIG. 3A, and hereby the responsiveness can be improved when adjusting the temperature of the hot air. And in this case, it is further preferable to provide the heaters 67*ha*, 67*hb* to each of the blast openings 63Na, 63Nb. In other words, it is preferable to provide the heater 67*ha* to correspond to the outgoing route blast orifice 63Na, and separate from this, the heater 67*hb* is provided to correspond to the return route blast opening 63Nb. Hereby, the temperature of the hot air can be adjusted for each of the blast openings 63Na, 63Nb so that the setting conditions of the bulk recovery process can be finely performed as a result.

Here, an electric heater which heats using electricity (kW) can be employed as the above heaters 67*h*, 67*ha*, 67*hb*. However, it is not limited to such and any device may do as long as it can heat air which forms wind.

And in this example, the "wind" indicates flows of air but includes in a broad sense, flows of gas such as nitrogen gas and inactive gas besides flows of air. In other words, nitrogen gas and the like may be blown out from the blast openings 63Na, 63Nb.

Further in the present embodiment, each exit portion of the discharge openings 63*ha*, 63*hb* has one end sides of the recovery tube member 69 connected and the other end sides of the recovery tube member 69 communicate with the suction side part 67*bs* of the air blower 67*b*. Hereby, the hot air flowing through the spaces SP62*a*, SP62*b* are recovered to be returned to the suction side part 67*bs* of the air blower 67*b*. The recovered hot air is heated with the heater 67*h* by applying outside air and then supplied again to the heating unit 61. Recovery of the hot air allows reusing of a part of the energy while suppressing negative effects to the other proximate semimanufactured products when the hot air is discharged in the heating unit 61.

In the present embodiment, discharging of the hot air from the discharge openings 63*ha*, 63*hb* is performed from the end portion side along the CD direction of the case member 62. Further, discharging of the hot air from the discharge openings 63*ha*, 63*hb* is performed on the same side where the hot air is supplied to the pressure chambers R63*a*, R63*b*. In other words, in the present embodiment, the hot air is supplied to the heating portion 60 from one end side in the CD direction and the hot air is discharged from the same side. The tube member 67*p* for supplying hot air and the recovery tube member 69 being connected on the same side with respect to the CD direction allows to reduce the piping space in turn allowing to minimize the device as a whole.

By the way, in cases where the aforementioned plate-like members 63*wam*, 63*wbm* are not provided, or where the foreign matters such as the fiber dust of the nonwoven fabric 3 is so small that they would pass through the plate-like members 63*wam*, 63*wbm*, there is a possibility that the foreign matters would pass through the recovery tube member 69 and be sent to the heater 67*h* inside the air blower 67*b* and bond thereto due to the heat. Therefore, it is preferable that for example, a predetermined meshed filter member for preventing foreign matters to be drawn in is inserted between the suction side part 67*bs* of the air blower 67*b* and the recovery tube member 69. It is preferable that a similar kind of filter member is provided to also the suction side part 67*bs* in the example in FIG. 3A since there is a possibility that foreign matters such as paper dust in the manufacturing line may be mixed with outside air to be drawn in from the suction side part 67*bs*.

The heating unit 61 in the examples of FIGS. 2 and 3 is a horizontal-mount type with the lengthwise direction of the case member 62 being directed along the horizontal direction and hereby, the outgoing route and the return route of the transfer path of the nonwoven fabric 3 are arranged horizontally, however, it is not limited to such. In other words, the heating unit 61 may be a vertical-mount type. To be specific, the lengthwise direction of the case member 62 may be directed in the vertical direction to thereby allow the outgoing route and return route of the transfer path of the nonwoven fabric 3 to be arranged vertically. And furthermore, the lengthwise direction of the case member 62 may be arranged inclined from the vertical direction and the horizontal direction according to the layout circumstances. However, the vertical-mount type is excellent since the planar area required for placing the heating unit 61 is small.

<Nonwoven Fabric Bulk Recovery Operation>

Description of the nonwoven fabric 3 bulk recovery operation inside the case member 62 of the heating unit 61 will be given. Here in the present embodiment, the outgoing route space SP62*a* and the return route space SP62*b* have substantially the same configuration and the way in which the hot air flows inside the case member 62 and the bulk recovery operation of the nonwoven fabric 3 are also substantially the same. Therefore, description of mainly the outgoing route space SP62*a* will be given in the following and description of the return route space SP62*b* may be omitted.

Firstly, the hot air supplied from the hot air supply device 67 is supplied to the pressure chamber R63*a* provided to the partitioning member 63. The sectional shape (the shape at the section having the normal direction thereof directed in the CD direction) of the pressure chamber R63*a* is in a tapered shape becoming substantially narrower toward the downstream side of the transfer direction, and the pressure chamber R63*a* comes into communication with the outgoing route space SP62*a* at the tip end portion of the tapered shape so to thereby allow the tip end portion function as the aforementioned blast opening 63Na.

The hot air blasted from the outgoing route blast orifice 63Na comes into contact with the surface of the nonwoven fabric 3 with a velocity component of that on the downstream side along the transfer direction, and thereafter flows along this surface as it is (the hot air flow is indicated with thick arrows in FIG. 4.) And the hot air flows from the upstream side along the transfer direction through the second and first positions indicated in FIG. 4 and toward the downstream side along the transfer direction. Since the hot air moves along the transfer direction in a manner flowing along the surface of the nonwoven fabric 3, troubles of the hot air compressing the nonwoven fabric 3 in the thickness direction of the nonwoven fabric 3 is effectively avoided so to hereby allow a smooth bulk recovery.

At this event, the wind speed value Vw (m/min) of the hot air can be made greater than the transfer speed value V3 (m/min) of the nonwoven fabric 3 by adjusting the air volume ($m^3$/min) of the hot air. And in this way, the hot air blasted from the blast openings 63Na, 63Nb would pass the nonwoven fabric 3 swiftly along the surface of the nonwoven fabric 3 to be discharged outside from the discharge openings 63*ha*, 63*hb* in the end. Therefore, this hot air can easily become turbulent based on the relative speed difference between the hot air and the nonwoven fabric 3. And as a result, the heat-transfer efficiency is dramatically improved so that the nonwoven fabric 3 can be heated efficiently allowing quick bulk recovery. Further, since the fibers of the nonwoven fabric 3 are randomly loosened by the hot air turbulence, this also promotes the bulk recovery.

By the way, the wind speed value Vw (m/min) (hereinafter also referred to as the hot air flow rate) of the hot air is a value obtained by, for example, dividing the air volume ($m^3$/min) supplied to the outgoing route space SP62*a* or the return route space SP62*b* by the sectional area (i.e., the area of the section having the transfer direction as the normal direction thereof) of the outgoing route space SP62*a* or the return route space SP62*b*.

Further, it is preferable that the magnitude relationship between the aforementioned wind speed value Vw and the transfer speed value V3 is established along the entire transfer direction of the outgoing route space SP62*a* or the return route space SP62*b*, however, it need not be established along the entire length thereof. In other words, the functional effect of the aforementioned turbulent state can be relished if the aforementioned magnitude relationship is established at a part of the spaces SP62*a*, SP62*b*.

Note that in the present embodiment, some of the surrounding air (exterior of the case member 62) is sucked in to enter into the outgoing route space SP62*a* when the transferred nonwoven fabric 3 enters from the entrance 62*ain* into the interior of the case member 62. And the sucked air forms an accompanying flow which flows in the transfer direction by moving along with the transferred nonwoven fabric 3. Since this accompanying flow flows along the transfer direction, the hot air blasted from the blast opening 63Na is likely to flow along the transfer direction so as to be made to flow by this accompanying flow.

Further, the shapes of each of the outgoing route and the return route blast openings 63Na, 63Nb are in rectangular forms having the longitudinal direction directed along the CD direction. And the dimension in the CD direction of the outgoing route blast orifice 63Na is set to have the same value as the dimension along the CD direction of the outgoing route space SP62*a* and the dimension in the CD direction of the return route blast opening 63Nb is set to have the same value as the dimension in the CD direction of the return route space SP62*b*, however, it is not limited to such. For example the blast openings 63Na, 63Nb may be smaller. But, it is preferable that the dimensions along the CD direction of the blast openings 63Na, 63Nb are greater than the width dimension (dimension along the CD direction) of the nonwoven fabric 3, and thereby uneven heating along the CD direction can be suppressed.

Additionally, the dimensions (the dimensions along the direction that is orthogonal to the dimensions along the aforementioned CD direction) in the crosswise directions of the blast openings 63Na, 63Nb are arbitrarily selected from the range of, for example, 1 mm to 10 mm, and to be set.

Further, is preferable that the angle θ of the hot air blasting direction with respect to the transfer direction of the nonwoven fabric 3 at the locations of the blast openings 63Na, 63Nb is within the range of 0 to 30 degrees and more preferably within the range of 0 to 10 degrees (see FIG. 3A.) And when configured in this way, the hot air can be allowed to flow along the surface of the nonwoven fabric 3 easily.

Here in the example illustrated in FIG. 2, the heating unit 61 is a horizontal-mount type having the lengthwise direction of the case member 62 directed along the horizontal direction and hereby, the outgoing route and return route in relation with the transfer path of the nonwoven fabric 3 were placed horizontally, however, it is not limited to such. In other words, there may be a case where the heating unit 61 is a vertical-mount type. More specifically, the lengthwise direction of the case member 62 may be directed along the vertical direction hereby allowing the outgoing route and return route in relation with the transfer path of the nonwoven fabric 3 to be placed vertically. Furthermore, the lengthwise direction of the case member 62 may be arranged inclined from both the vertical and the horizontal directions according to the layout circumstances. However, the vertical-mount type is excellent since the planar area required for placing the heating unit 61 is small.

<Hot Air Flow Rate>

Description has been given that the bulk recovery of the nonwoven fabric 3 can be enhanced by making the hot air be in a turbulent state by increasing the flow rate Vw of the hot air blasted inside the case member 62 in the heating unit 61 to be greater than the transfer speed value V3 of the nonwoven fabric. Meanwhile, there is a case where problems arise when the Vw is too high. Issues arising when the Vw is too high will be described using a comparison example.

Figure 5:
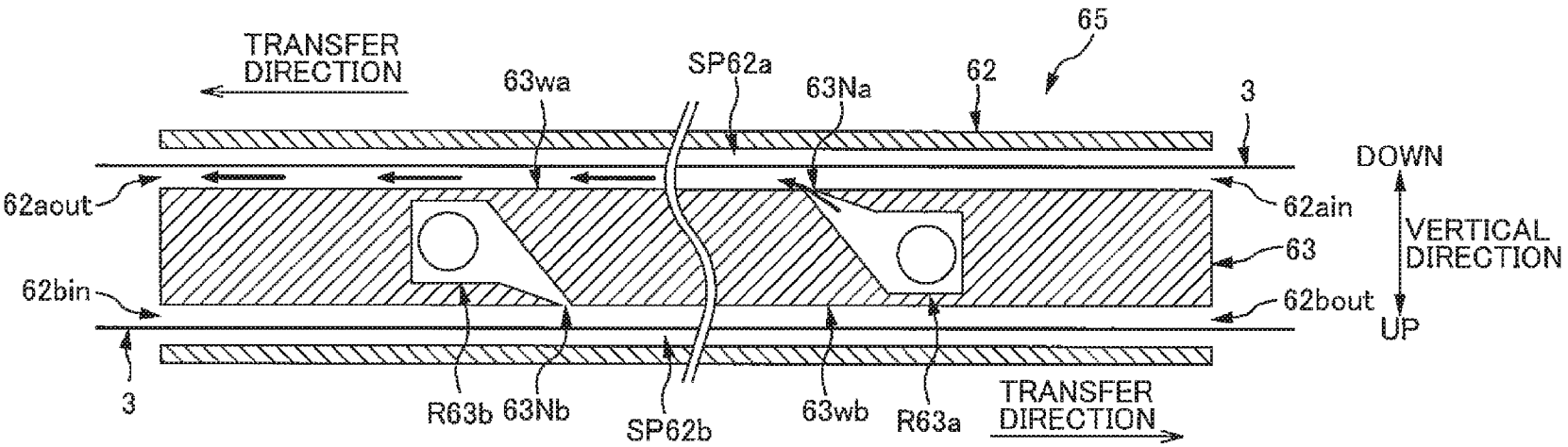
FIG. 5 is a view illustrating the details of the interior in the case member 62 of a conventional heating unit 65 in a comparative example.

FIG. 5 is a diagram illustrating the details of the interior in the case member 62 of a conventional heating unit 65 as a comparative example. The basic configuration of the heating unit 65 of the comparative example is substantially the same as the heating unit 61 according to the present embodiment, however, the shape of the partitioning member 63 is different. Specifically, the heating unit 65 of the comparative example does not have the level differentiated part 63*wae* provided to the outgoing route wall surface 63*wa* of the partitioning member 63. In other words, the outgoing route wall surface 63*wa* has the part that comes along the entrance 62*ain* to the exit 62*aout* of the case member formed in a planar form along the transfer direction and does not have an enlarged area formed in the outgoing route space SP62*a*. Thus in the case of the comparative example, the sectional area of the outgoing route space SP62*a* is fixed from the upstream side to the downstream side along the transfer direction. And since the sectional area is fixed, the flow rate Vw (m/min) of the hot air flowing inside the outgoing route space SP62*a* would also be substantially stable along the upstream side to the downstream side of the transfer direction.

By the way, the heating unit 65 of the comparative example continues to have the nonwoven fabric 3 subject to hot air during the process of the nonwoven fabric 3 being transferred inside the case member 62. In other words, the hot air blasted from the blast opening 63Na provided, to the case member 62, at the upstream side in the transfer direction, flows to the downstream side in the transfer direction along the surface of the nonwoven fabric 3 during which the nonwoven fabric 3 is heated. In other words, the nonwoven fabric 3 would have applied heat quantity in an accumulating manner while being transferred from the upstream side to the downstream side along the transfer direction. When such a large heat quantity is applied to the nonwoven fabric 3 in this way, the nonwoven fabric 3 can stretch easily in the transport direction. As explained with respect to FIG. 2, since the nonwoven fabric 3 is transferred in a state being applied in the transfer direction a tensile force (tension) of a predetermined magnitude, a tensile force would act on the nonwoven fabric 3 having the fibers softened by the heat so to pull the nonwoven fabric 3 toward both end sides of the transfer direction and thus the nonwoven fabric 3 can stretch easily.

The hot air flowing along the transfer direction along the surface of the nonwoven fabric 3 in the heating unit 65 acts as a tractional force pulling the nonwoven fabric 3 along the transfer direction and thus the nonwoven fabric 3 can be further easily stretched. Particularly, since the hot air flow rate Vw flowing inside the return route space SP62*b* is substantially stable in the comparative example, the hot air flow rate Vw in the downstream side along the transfer direction would remain high when the hot air flow rate Vw blasted from the blast opening 63Na is high, and so the tractional force pulling the nonwoven fabric 3 in this area would also be large.

When the nonwoven fabric 3 stretches by being pulled in the transfer direction, the bulk at the surface of the part of the nonwoven fabric 3 being stretched would easily flatten so that a sufficient bulk recovery effect would not be achieved. Further, there is a possibility of the nonwoven fabric 3 becoming a non-conforming item which does not satisfy the standard size as a product since the length along the CD direction (i.e., the width of the nonwoven fabric) would shorten along with the stretching of the nonwoven fabric 3 along the transfer direction.

Therefore, in the heating unit 65 with a structure as that in the comparative example, it would be difficult to perform a normal bulk recovery depending on the flow rate of the hot air Vw. Further, there is a possibility that the quality of the product would deteriorate. Thus it would be required to set a limit to the condition (upper speed limit) of the hot air flow rate Vw in the comparative example thereby making it difficult to adapt to various operating conditions.

On the other hand, the heating unit 61 according to the present embodiment can reduce the flow rate Vw in the downstream side area along the transfer direction making it difficult for the nonwoven fabric 3 to be stretched.

As aforementioned, in the present embodiment, the level differentiated part 63*wae* is provided to the downstream side area of the partitioning member 63 along the transfer direction, and the sectional area of the outgoing route space SP62*a* is widened in this area (aforementioned enlarged area.) In FIG. 4, when the sectional area at the first position in the outgoing route space SP62*a* (sectional area after widening) is defined as Dad, the sectional area at the second position in the outgoing route space SP62*a* (sectional area before widening) is defined as Dau, and the hot air flow rate at the first position in the outgoing route space SP62*a* is defined as Vwad, the hot air flow rate at the second position in the outgoing route space SP62*a* is defined as Vwau, expression Dau×Vwau−Dad×Vwad would hold when the flow rate per unit time of the hot air blasted into the outgoing route space SP62*a* is stable. Here, although pressure loss and heat loss would actually occur inside the space SP62*a*, such effects are regarded to be negligible since the effects thereof to the entire configuration are minor.

In the case of the present embodiment, the hot air flow rate Vwau>Vwad holds since the relation of the sectional area of the outgoing route space SP62*a* Dau<Dad holds. In other words, the hot air flow rate Vwad at the area on the downstream side along the transfer direction (first position) would be lower than the hot air flow rate Vwau at the area on the upstream side along the transfer direction (second position.) Therefore, the tractional force applied to the nonwoven fabric 3 in the transfer direction due to the flow of the hot air in the enlarged area on the downstream side along the transfer direction will be smaller than that in the comparative example. Hereby, the nonwoven fabric 3 is not stretched easily on the downstream side along the transfer direction where the effect of heating with the hot air is large thereby allowing ease to perform a normal bulk recovery. Further, since the flow rate can be lowered in the enlarged area even when the hot air flow rate blasted from the blast opening 63Na is high, constraints on the hot air flow rate is small.

Further in the heating unit 61 according to the present embodiment, the discharge opening 63*ha* was provided in the enlarged area of the space SP62*a* to allow discharge of hot air outside. Hereby, the volume of the hot air can be reduced in the downstream side area along the transfer direction (enlarged area) and thus the hot air flow rate can be lowered in turn allowing the conditions during bulk recovery operation to be easily adjusted.

Furthermore, the discharge opening 63*ha* is provided to a location shifted vertically from the transfer path of the nonwoven fabric 3. In the example illustrated in FIG. 4, the discharge opening 63*ha* is provided vertically upward from the transfer path of the nonwoven fabric 3. If the discharge opening 63*ha* were to be provided at a position vertically the same as the transfer path of the nonwoven fabric 3, the nonwoven fabric 3 being transferred would also be drawn toward the direction of the discharge opening 63*ha* (i.e., end portion side in the CD direction) by the flow of hot air being discharged from the discharge opening 63*ha* thereby causing a possibility of the nonwoven fabric 3 being interfered from having performed a correct transfer operation. On the other hand, since the discharge opening 63*ha* according to the present embodiment is provided to a location shifted from the transfer path of the nonwoven fabric 3, the transfer operation is unlikely to be interfered.

Even furthermore, in the present embodiment, the blast opening 63Na which blasts hot air inside the case member 62 and the discharge opening 63*ha* which discharges hot air outside from the case member 62 are both provided to locations vertically shifted to the same side with respect to the transfer path of the nonwoven fabric 3. Specifically, in the case illustrated in FIG. 4, the blast opening 63Na and the discharge opening 63*ha* are both positioned at locations shifted vertically upward with respect to the transfer path of the nonwoven fabric. The hot air blasted from the blast opening 63Na to the space SP62*a* flows from the upstream side to the downstream side in the transfer direction along one face (the face on the top face side in the vertical direction in FIG. 4) of the nonwoven fabric 3 to be discharged from the discharge opening 63*ha*. In other words, the hot air flows along one face of the nonwoven fabric 3 (the face on the top face side in the vertical direction in FIG. 4) to the downstream side in the transfer direction without penetrating the nonwoven fabric 3 in the vertical direction. Hereby, one face of the nonwoven fabric 3 is sufficiently heated so that an efficient bulk recovery can be performed.

Further in the present embodiment, an exit portion wall face 63*was* was provided at a portion in the space SP62*a* most downstream along the transfer direction and an exit 62*aout* of the case member 62 was formed with this exit portion wall face 63*was*. As is clear from FIG. 4, the sectional area of the exit 62*aout* (the area of the section having the transfer direction as the normal direction thereof) is narrower than the sectional area of the enlarged area. In other words, the sectional area of the outgoing route space SP62*a* in the present embodiment is narrow at the area (e.g., the second position in FIG. 4) on the upstream side along the transfer direction, widened at the area (e.g., the first position in FIG. 4) on the downstream side along the transfer direction and narrowed once again at a portion (position at exit 62*aout*) most downstream along the transfer direction. Narrowing the dimension of the exit in this way allows conditioning of the hot air flow proximate this exit portion.

For example, when the exit portion wall face 63*was* is not provided to the outgoing route space SP62*a* of the heating unit 61, the sectional area of the exit 62*aout* would be about the same as the sectional area (corresponding to the aforementioned sectional area Dad at the first position) of the space SP62*a* which was widened by the level differentiated part 63*wae* and would be wider than that in the case in FIG. 4. When the sectional area of the exit 62*aout* is wide, the hot air flowing in the space SP62*a* would expand to directions other than the transfer direction in the enlarged area on the downstream side along the transfer direction, and then discharged from the exit 62*aout* (or discharge opening 63*ha*) as it is. In other words, a speed component in a direction other than that in the transfer direction will be added to the hot air flow so that a turbulent would likely be generated to the hot air flow. With an effect thereof, the transfer operation of the nonwoven fabric 3 will be disturbed thereby easily causing flattering and the like in the vertical direction and the CD direction, in FIG. 4, and thus a stable bulk recovery may not be performed.

On the other hand, when the sectional area of the exit 62*aout* is narrowed as in FIG. 4, the hot air flow expanded in the enlarged area will be narrowed at the exit part for the flow to be conditioned so that the disturbance of the transfer operation of the nonwoven fabric 3 is solved thereby allowing a stable bulk recovery operation to be performed. Here, depending on the hot air flow rate Vw, there is a case where the normal bulk recovery operation can be performed without disturbing the transfer operation of the nonwoven fabric 3 even when the exit portion wall face 63*was* is not provided.

Further, since the transfer operation of the nonwoven fabric 3 can be easily stabilized when the direction of the hot air flow and the transfer direction of the nonwoven fabric 3 is made close to parallel as possible, it is preferable that the vertical position of the exit 62*aout* is made to correspond to the position at the upstream side area along the transfer direction of the space SP62*a*. In FIG. 4, the vertical position of the exit 62*aout* of the space SP62*a* and the vertical position of the entrance 62*ain* is made to correspond thereby allowing the hot air to flow linearly along the transfer direction easily.

In the present embodiment, the interior of the case member 62 being configured in the above manner allows appropriate adjustment of the hot air flow in the downstream side area along the transfer direction (enlarged area) at each of the outgoing route space SP62*a* and the return route space SP62*b*. Hereby, stretching of the nonwoven fabric 3 in the transfer direction at this area can be suppressed in turn allowing a correct bulk recovery operation to be realized.

Other Embodiments

Hereinabove, embodiments of the present invention have been described, however, the foregoing embodiments are intended to facilitate the understanding of the present invention but not to limit the invention. And it is needless to say that modifications and improvements of the present invention are possible without departing from the scope of the invention, and equivalents thereof are also encompassed by the invention. For example, the following modifications are possible.

In the aforementioned embodiment, the nonwoven fabric 3 for top sheets 3 of pee pads 1 for pets had been exemplified as the target to be processed by the bulk recovery apparatus 20, however, it is not limited to such. For example, nonwoven fabric for top sheets of sanitary napkins and nonwoven fabric for top sheets of diapers may be the targets. Further, the target to be processed by the bulk recovery apparatus 20 is not at all limited to nonwoven fabric 3 for the top sheet 3. In other words, nonwoven fabric of materials of other components which require to be bulky may processed with the bulk recovery apparatus 20 according to the present invention.

In the aforementioned embodiment, as illustrated in FIG. 1B, a nonwoven fabric 3 having on one face a plurality of linear bumps 3*p*, 3*p* . . . had been exemplified as an example of the nonwoven fabric 3 for the top sheet 3, however, it is not limited to such. For example, nonwoven fabric of a common type, that is, nonwoven fabric having substantially flat faces on both faces thereof may do.

In the aforementioned embodiment, as illustrated in FIG. 2, the heating unit 61 of the heating portion 60 heated the nonwoven fabric 3 on both the outgoing route and the return route, however, it is not limited to such. For example, either the outgoing route blast orifice 63Na or the return route blast opening 63Nb may be omitted when the bulk can be sufficiently recovered on either one of the outgoing route and the return route. Reversely, when two paths of the outgoing route and the return route are not enough for bulk recovery, a plurality of the aforementioned heating units 61, rather than one, may be provided with three or more paths heating the nonwoven fabric 3. Note that, it is preferable to provide the blast openings 63Na, 63Nb in a manner respectively corresponding to the outgoing route and the return route so that the length of the heating unit 61 in the lengthwise direction is shortened while securing a sufficient transfer pathway length for the bulk recovery of the nonwoven fabric 3.

In the aforementioned embodiment, a solid member which does not include space inside besides the pressure chambers R63*a*, R63*b* and the enlarged areas formed with the level differentiated parts 63*wae*, 63*wbe* had been used as the material of the partitioning member 63, however, it is not limited to such. For example, hollow members including a space inside may be used for the purposed of weight reduction. For example, a member made of a combination of a stainless steel flat plate member (not shown) which forms the outgoing route wall surface 63*wa* in FIG. 3A, a stainless steel flat plate member (not shown) which forms the return route wall surface 63*wb*, and a rectangular column (not shown) which is inserted between these flat plate members to connect the flat plate members can be given as an example of a hollow member.

In the aforementioned embodiment, the spaces SP62*a*, SP62*b* were expanded in the vertical direction with the level differentiated parts 63*wae*, 63*wbe*, however, the way in which the spaces SP62*a*, SP62*b* are expanded are not limited to such. For example, the spaces SP62*a*, SP62*b* may be expanded in the CD direction in the downstream side area along the transfer direction. Since the hot air flow rate can be minimized in this area even when the spaces SP62*a*, SP62*b* are expanded in the CD direction, the stretching of the nonwoven fabric 3 in the transfer direction can be suppressed to allow a normal bulk recovery operation.

Further in the aforementioned embodiment, when the sectional areas of the spaces SP62*a*, SP62*b* were expanded with the level differentiated parts 63*wae*, 63*wbe*, the sectional forms along the transfer direction in the spaces SP62*a*, SP62*b* were expanded in a stepwise manner as illustrated in FIG. 4, however, it is not limited to such. For example, a tapered member (not shown) may be provided instead of the level differentiated parts 63*wae*, 63*wbe* to be in a form having the sectional areas of the spaces SP62*a*, SP62*b* gradually increase while proceeding from the upstream side to the downstream side along the transfer direction, in a form having the spaces SP62*a*, SP62*b* widened in a plurality of steps, or in other forms.

REFERENCE SIGNS LIST

1 pee pads for pets (absorbent article)
2 top sheet (nonwoven fabric), 3R nonwoven fabric roll,
3*a* face, 3*b* face, 3*e* circumferential edge,
3*t* groove, 3*p* bump, 3*h* through hole,
4 absorbent body, 4*c* absorbent core,
4*t*1 covering sheet, 4*t*2 covering sheet,
5 back sheet,
20 bulk recovery apparatus,
30 transfer portion,
32 transfer roller,

32*u* upstream side drive transfer roller, 32*d* downstream side drive transfer roller,
35 supply device,
60 heating portion, 61 heating unit, 62 case member,
62*ain* entrance, 62*aout* exit,
62*bin* entrance, 62*bout* exit,
63 partitioning member,
63Na blast opening, 63Nb blast opening,
63*ha* discharge opening, 63*hb* discharge opening,
63*wa* outgoing route wall surface, 63*wae* level differentiated part, 63*wam* plate-like member,
63*was* exit portion wall face,
63*wb* return route wall surface, 63*wbe* level differentiated part, 63*wbm* plate-like member,
63*wbs* exit portion wall face,
64 guide roller,
67 hot air supply device,
67*b* air blower, 67*bs* suction side part
67*h* heater, 67*ha* heater, 67*hb* heater,
67*i* impeller, 67*p* tube member, 69 recovery tube member,
SP62*a* outgoing route space, SP62*b* return route space,
R63*a* pressure chamber, R63*b* pressure chamber

The invention claimed is:

1. An apparatus that recovers a bulk of a nonwoven fabric by blowing hot air and heating the nonwoven fabric that is transferred in a transfer direction, comprising:

a case member that has both end portions thereof in the transfer direction opened;

an entrance that is provided to an opening on one end side, in the transfer direction, of the case member, the entrance being used to transfer the nonwoven fabric;

an exit that is provided to an opening on an other end side, in the transfer direction, of the case member, the exit being used to transfer the nonwoven fabric; and a blast opening that is provided to a part on the entrance side of the case member and blasts into a space inside the case member the hot air toward a part on the exit side, wherein a sectional area at a first position, of the space inside the case member, on a downstream side along the transfer direction with respect to a position where the blast opening is provided, is wider than a sectional area at a second position, of the space inside the case member, located between the position where the blast opening is provided and the first position and the hot air that is blasted from the blast opening flows from an upstream side along the transfer direction through the first and second positions and to the downstream side along the transfer direction while coming into contact with one face of two faces of the nonwoven fabric in the space inside the case member.

2. The nonwoven fabric bulk recovery apparatus according to claim 1, wherein an area that includes the first position and has a sectional area wider than that at the second position, in the space inside the case member has provided a discharge opening that discharges to an outside the hot air blasted in the space inside the case member.

3. The nonwoven fabric bulk recovery apparatus according to claim 2, wherein the discharge opening is provided to a location vertically shifted from a path along which the nonwoven fabric is transferred.

4. The nonwoven fabric bulk recovery apparatus according to claim 3, wherein the blast opening and the discharge opening are both provided at locations vertically shifted to a same side with respect to the path along which the nonwoven fabric is transferred.

5. The nonwoven fabric bulk recovery apparatus according to claim 2, wherein a member that blocks a part of a space on an exit side of the space inside the case member is provided at a part most downstream along the transfer direction in the space inside the case member.

6. The nonwoven fabric bulk recovery apparatus according to claim 2, further comprising a hot air supply device that supplies the hot air to an inside of the case member, wherein the hot air supply device recovers the hot air discharged from the discharge opening to resupply to an inside of the case member.

7. The nonwoven fabric bulk recovery apparatus according to claim 6, further comprising a CD direction that is a direction orthogonal to each of a vertical direction of the case member and the transfer direction, wherein the discharge of the hot air from the discharge opening and the supply of the hot air to the inside of the case member are performed on a same side with respect to the CD direction of the case member.

8. A method of recovering a bulk of a nonwoven fabric by blowing hot air and heating the nonwoven fabric that is transferred in a transfer direction, comprising:

providing an entrance to an opening on one end side in the transfer direction to transfer the nonwoven fabric and providing an exit to an opening on an other end side in the transfer direction to transfer the nonwoven fabric, in a case member that has both end portions thereof in the transfer direction opened, blasting from a blast opening provided to a part on the entrance side of the case member the hot air toward a part on the exit side and into a space inside the case member; and in the case member having a sectional area, in the space inside the case member, at a first position that is located on a downstream side along the transfer direction with respect to a position where the blast opening is provided, wider than a sectional area, in the space inside the case member, at a second position that is located between the position where the blast opening is located and the first position, allowing the hot air blasted from the blast opening to flow from an upstream side along the transfer direction through the first and the second positions and to the downstream side along the transfer direction while coming into contact with one face of two faces of the nonwoven fabric.

* * * * *